US005772705A

United States Patent [19]

Caprotti

[11] Patent Number: 5,772,705

[45] Date of Patent: Jun. 30, 1998

[54] FUEL OIL COMPOSITIONS

[75] Inventor: Rinaldo Caprotti, Oxfordshire, United Kingdom

[73] Assignee: Exxon Chemical Patents Inc., Linden, N.J.

[21] Appl. No.: 750,306

[22] PCT Filed: Jun. 8, 1995

[86] PCT No.: PCT/EP95/02251

§ 371 Date: Dec. 5, 1996

§ 102(e) Date: Dec. 5, 1996

[87] PCT Pub. No.: WO95/33805

PCT Pub. Date: Dec. 14, 1995

[30] Foreign Application Priority Data

Jun. 9, 1994 [GB] United Kingdom ..... 9411614

[51] Int. Cl.[6] ..... C10L 1/14; C10L 1/22

[52] U.S. Cl. ..... 44/389; 44/390; 44/405; 44/412

[58] Field of Search ..... 44/390, 405, 389, 44/412

[56] References Cited

U.S. PATENT DOCUMENTS

| | | | |
|---|---|---|---|
| 3,092,474 | 6/1963 | Ebner | 44/405 |
| 3,166,387 | 1/1965 | Ebner | 44/405 |
| 4,127,139 | 11/1978 | Sweeney | 44/390 |
| 4,127,140 | 11/1978 | Sweeney | 44/390 |
| 4,708,993 | 11/1987 | Naiman et al. | 44/390 |
| 5,156,655 | 10/1992 | Baillargeon et al. | 44/405 |

*Primary Examiner*—Jacqueline V. Howard
*Attorney, Agent, or Firm*—Ohlandt, Greeley, Ruggiero & Perle

[57] ABSTRACT

The lubricity of low sulphur fuels is enhanced by incorporation of a cold flow improver.

10 Claims, No Drawings

FUEL OIL COMPOSITIONS

This invention relates to fuel oils, and to the use of additives to improve the characteristics of fuel oils, more especially of diesel fuel and kerosene.

Environmental concerns have led to a need for fuels with reduced sulphur content, especially diesel fuel and kerosene. However, the refining processes that produce fuels with low sulphur contents also result in a product of lower viscosity and a lower content of other components in the fuel that contribute to its lubricity, for example, polycyclic aromatics and polar compounds. Furthermore, sulphur-containing compounds in general are regarded as providing anti-wear properties and a result of the reduction in their proportions, together with the reduction in proportions of other components providing lubricity, has been an increase in reported failures of fuel pumps in diesel engines using low-sulphur fuels, the failure being caused by wear in, for example, cam plates, rollers, spindles and drive shafts.

This problem may be expected to become worse in future because, in order to meet stricter requirements on exhaust emissions generally, high pressure fuel pumps, including in-line, rotary and unit injector systems, are being introduced, these being expected to have more stringent lubricity requirements than present equipment, at the same time as lower sulphur levels in fuels become more widely required.

At present, a typical sulphur content in a diesel fuel is about 0.25% by weight. In Europe maximum sulphur levels are being reduced to 0.20%, and are expected to be reduced to 0.05%; in Sweden grades of fuel with levels below 0.005% (Class 2) and 0.001% (Class 1) are already being introduced. A fuel oil composition with a sulphur level below 0.20% by weight is referred to herein as a low-sulphur fuel.

The present invention is based on the observation that a cold flow improver enhances the lubricity of a low-sulphur fuel.

In a first aspect of the invention, there is provided the use of a cold flow improver to enhance the lubricity of a fuel oil composition having a sulphur content of at most 0.2% by weight, more especially of at most 0.05% by weight.

In a second aspect of the invention, there is provided a process for the manufacture of a petroleum based fuel oil of enhanced lubricity, which comprises refining a crude oil to produce a fuel oil of low sulphur content, and blending a cold flow improver with the refined product to provide a fuel oil composition with a sulphur content of at most 0.2% by weight, preferably of at most 0.05% by weight, and having a lubricity such as to give a wear scar diameter, as measured by the HFRR test (as hereinafter defined) at 60° C. of at most 500 $\mu$m, such as at most 450 $\mu$m, preferably at most 380 $\mu$m, more preferably at most 350 $\mu$m.

Advantageously, the petroleum-based fuel oil is a middle distillate fuel oil.

In a third aspect of the invention, there is provided a composition comprising a major proportion of a petroleum-based fuel oil and a minor proportion of a cold flow improver comprising an oil-soluble polar nitrogen compound carrying one or more substituents of the formulae $>NR^{13}$, where $R^{13}$ represents a hydrocarbyl group containing 8 to 40 carbon atoms, which substituent or one or more of which substituents may be in the form of a cation derived therefrom, the sulphur content of the composition being at most 0.2% by weight. Advantageously, the sulphur content is at most 0.05% by weight.

Advantageously, the petroleum-based fuel is a middle distillate fuel oil.

Said polar nitrogen compound may be used in combination with an ethylene-unsaturated ester copolymer flow improver.

Advantageously, the composition resulting from the use of the first aspect, and the composition of the third aspect of the invention have a lubricity as defined with reference to the second aspect.

As used herein, the term "cold flow improver" refers to any additive which will lower the vehicle operability temperature relative to untreated base fuel, as evidenced, for example by lowering the pour point, the cloud point, the wax appearance temperature, the cold filter plugging point (hereinafter CFPP) or the Low Temperature Flow Test (LTFT) temperature of a fuel, or will reduce the extent of wax settlement in a fuel, especially a middle distillate fuel.

As used herein, the term "middle distillate" refers to fuel oils obtainable in refining crude oil as the fraction from the lighter, kerosene or jet fuel, fraction to the heavy fuel oil fraction. The fuel oils may also comprise atmospheric or vacuum distillate, cracked gas oil or a blend, in any proportions, of straight run and thermally and/or catalytically cracked distillate. Examples include kerosene, jet fuel, diesel fuel, heating oil, visbroken gas oil, light cycle oil, vacuum gas oil, light fuel oil and fuel oil. Such middle distillate fuel oils usually boil over a temperature range, generally within the range of 100° C. to 500° C., as measured according to ASTM D86, more especially between 150° C. and 400° C.

It is within the scope of the invention to include as a component of the composition a vegetable-based fuel oil, or "biofuel", for example a rapeseed methyl ester or vegetable oil.

The HFRR, or High Frequency Reciprocating Rig, test is that described according to CEC F-06-T-94 and ISO TC22/SC7/WG6N180.

The CFPP test is defined in "Journal of the Institute of Petroleum", 52 (1966) pp 173 to 185.

The cold flow improvers usable in the present invention will now be described in further detail. Numerous classes of flow improvers, especially middle distillate flow improvers, are suitable for use in the present invention. Among these there may be mentioned:

(A) An ethylene-unsaturated ester copolymer, more especially one having, in addition to units derived from ethylene, units of the formula $$—CR^1R^2—CHR^3—$$

wherein $R^1$ represents hydrogen or methyl, $R^2$ represents $COOR^4$, wherein $R^4$ represents an alkyl group having from 1 to 9 carbon atoms, which is straight chain or, if it contains 3 or more carbon atoms, branched, or $R^2$ represents $OOCR^5$, wherein $R^5$ represents $R^4$ or H, and $R^3$ represents H or $COOR^4$.

These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, or ethylene-vinyl octanoate copolymer is preferred. Preferably, the copolymer contains from 5 to 40 wt% of the vinyl ester, more preferably from 10 to 35 wt% vinyl ester. A mixture of two copolymers, for example as described in U.S. Pat. No. 3,961,916, may be used. The number average molecular weight of the copolymer, as measured by vapour phase osmometry, is advantageously 1,000 to 10,000, preferably 1,000 to 5,000. If desired, the copolymer may contain units derived from additional comonomers, e.g. a terpolymer, tetrapolymer or a higher polymer, for example where the additional comonomer is isobutylene or disobutylene.

The copolymers may be made by direct polymerization of comonomers, or by transesterification, or by hydrolysis and re-esterification, of an ethylene unsaturated ester copolymer to give a different ethylene unsaturated ester copolymer. For example, ethylene-vinyl hexanoate and ethylene-vinyl octanoate copolymers may be made in this way, e.g., from an ethylene-vinyl acetate copolymer.

(B) A comb polymer. Such polymers are polymers in which branches containing hydrocarbyl groups are pendant from a polymer backbone, and are discussed in "Comb-Like Polymers. Structure and Properties", N.A. Plate and V P Shibaev, J. Poly. Sci. Macromolecular Revs., 8, p 117 to 253 (1974).

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer having, or a copolymer at least 25 and preferably at least 40, more preferably at least 50, molar percent of the units of which have, side chains containing at least 6, and preferably at least 10 carbon atoms.

As examples of preferred comb polymers there may be mentioned those of the general formula

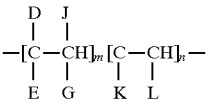

wherein D=$R^{11}$, $COOR^{11}$, $OCR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$ or COOH,

L=H, $R^{12}$, $COOR^{12}$, $OCOR^{12}$, or aryl, $R^{11} \leqq C_{10}$ hydrocarbyl, $R^{12} \leqq C_1$ hydrocarbyl or hydrocarbylene, and m and n represent mole fractions, m being finite and preferably within the range of from 1.0 to 0.4, n being less than 1 and preferably in the range of from 0 to 0.6. $R^{11}$ advantageously represents a hydrocarbyl group with from 10 to 30 carbon atoms, while $R^{12}$ advantageously represents a hydrocarbyl group with from 1 to 30 carbon atoms.

The comb polymer may contain units derived from other monomers if desired or required.

These comb polymers may be copolymers of maleic anhydride or fumaric or itaconic acids and another ethylenically unsaturated monomer, e.g., an Δ-olefin, including styrene, or an unsaturated ester, for example, vinyl acetate or homopolymer of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol or 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, -153177 and -225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred comb polymers are those having a number average molecular weight, as measured by vapour phase osmometry, of 1,000 to 100,000, more especially 1,000 to 30,000.

Other suitable comb polymers are the polymers and copolymers of Δ-olefins and esterified copolymers of styrene and maleic anhydride, and esterified copolymers of styrene and fumaric acid; mixtures of two or more comb polymers may be used in accordance with the invention and, as indicated above, such use may be advantageous. Other examples of comb polymers are hydrocarbon polymers, e.g., copolymers of ethylene and at least one Δ-olefin, the Δ-olefin preferably having at most 20 carbon atoms, examples being n-decene-1 and n-dodecene-1. Preferably, the number average molecular weight of such a copolymer is at least 30,000 measured by GPC. The hydrocarbon copolymers may be prepared by methods known in the art, for example using a Ziegler type catalyst.

(C) Polar nitrogen compounds.

Such compounds, as indicated above in respect of the composition aspect of the invention, are oil-soluble polar nitrogen compounds carrying one or more, preferably two or more, substituents of the formula $>NR^{13}$, where $R^{13}$ represents a hydrocarbyl group containing 8 to 40 carbon atoms, which substituent or one or more of which substituents may be in the form of a cation derived therefrom. $R^{13}$ preferably represents an aliphatic hydrocarbyl group containing 12 to 24 carbon atoms. The oil soluble polar nitrogen compound is generally one capable of acting as a wax crystal growth inhibitor in fuels.

Preferably, the hydrocarbyl group is linear or slightly linear, i.e. it may have one short length (1–4 carbon atoms) hydrocarbyl branch. When the substituent is amino, it may carry more than one said hydrocarbyl group, which may be the same or different.

The term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen.

More especially, the or each amino or imino substituent is bonded to a moiety via an intermediate linking group such as —CO—, —$CO_2$(−), —$SO_3$(−) or hydrocarbylene. Where the linking group is anionic, the substituent is part of a cationic group, as in an amine salt group.

When the polar nitrogen compound carries more than one amino or imino substituent, the linking groups for each substituent may be the same or different.

Suitable amino substituents are long chain $C_{12}$–$C_{40}$, preferably $C_{12}$–$C_{24}$, alkyl primary, secondary, tertiary or quaternary amino substituents.

Preferably, the amino substituent is a dialkylamino substituent, which, as indicated above, may be in the form of an amine salt thereof; tertiary and quaternary amines can form only amine salts. Said alkyl groups may be the same or different.

Examples of amino substituents include dodecylamino, tetradecylamino, cocoamino, and hydrogenated tallow amino. Examples of secondary amino substituents include dioctadecylamino and methylbehenylamino. Mixtures of amino substituents may be present such as those derived from naturally occurring amines. A preferred amino substituent is the secondary hydrogenated tallow amino substituent, the alkyl groups of which are derived from hydrogenated tallow fat and are typically composed of approximately 4% $C_{14}$, 31% $C_{16}$ and 59% $C_{18}$ n-alkyl groups by weight.

Suitable imino substituents are long chain $C_{12}$–$C_{40}$, preferably $C_{12}$–$C_{24}$, alkyl substituents.

Said moiety may be monomeric (cyclic or non-cyclic) or polymeric. When non-cyclic, it may be obtained from a cyclic precursor such as an anhydride or a spirobislactone.

The cyclic ring system may include homocyclic, heterocyclic, or fused polycyclic assemblies, or a system where two or more such cyclic assemblies are joined to one another and in which the cyclic assemblies may be the same or different. Where there are two or more such cyclic assemblies, the substituents may be on the same or different assemblies, preferably on the same assembly. Preferably, the or each cyclic assembly is aromatic, more preferably a benzene ring. Most preferably, the cyclic ring system is a single benzene ring when it is preferred that the substituents are in the ortho or meta positions, which benzene ring may be optionally further substituted.

The ring atoms in the cyclic assembly or assemblies are preferably carbon atoms but may for example include one or more ring N, S or O atom, in which case or cases the compound is a heterocyclic compound.

Examples of such polycyclic assemblies include (a) condensed benzene structures such as naphthalene, anthracene, phenanthrene, and pyrene;

(b) condensed ring structures where none of or not all of the rings are benzene such as azulene, indene, hydroindene, fluorene, and diphenylene oxides:

(c) rings joined "end-on" such as diphenyl;

(d) heterocyclic compounds such as quinoline, indole, 2:3 dihydroindole, benzofuran, coumarin, isocoumarin, benzothiophen, carbazole and thiodiphenylamine;

(e) non-aromatic or partially saturated ring systems such as decalin (i.e. decahydronaphthalene), Δ-pinene, cardinene, and bornylene; and (f) three-dimensional structures such as norbornene, bicycloheptane (i.e. norbornane), bicyclooctane, and bicyclooctene.

Examples of polar nitrogen compounds are described below:

(i) an amine salt and/or amide of a mono- or polycarboxylic acid, e.g. having 1 to 4 carboxylic acid groups. It may be made, for example, by reacting at least one molar proportion of a hydrocarbyl substituted amine with a molar proportion of the acid or its anhydride.

When an amide is formed, the linking group is —CO—, and when an amine salt is formed, the linking group is —$CO_2$(−).

The moiety may be cyclic or non-cyclic. Examples of cyclic moieties are those where the acid is cyclohexane 1,2-dicarboxylic acid; cyclohexane 1,2-dicarboxylic acid; cyclopentane 1,2-dicarboxylic acid; and naphthalene dicarboxylic acid. Generally, such acids have 5 to 13 carbon atoms in the cyclic moiety. Preferred such cyclic acids are benzene dicarboxylic acids such as phthalic acid, isophthalic acid, and terephthalic acid, and benzene tetracarboxylic acids such as pyromelletic acid, phthalic acid being particularly preferred. U.S. Pat. No. 4,211,534 and EP-A-272,889 describes polar nitrogen compounds containing such moieties.

Examples of non-cyclic moieties are those when the acid is a long chain alkyl or alkylene substituted dicarboxylic acid such as a succinic acid, as described in U.S. Pat. No. 4,147,520 for example.

Other examples of non-cyclic moieties are those where the acid is a nitrogen-containing acid such as ethylene diamine tetracetic acid and nitriloacetic acid, as described in DE-A-3,916,366 (equivalent to CA-A-2,017,126) (BASF).

Further examples are the moieties obtained where a dialkyl spirobislactone is reacted with an amine as described in EP-A-413,279 (Hoechst).

(ii) EP-A-0,261,957 describes polar nitrogen compounds according to the present description of the general formula

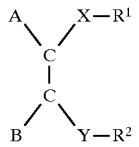

in which —Y—$R^2$ is $SO_3$(−)(+)$NR_3R^2$, —$SO_3$(−)(+)$HNR_2{}^3R^2$, —$SO_3$(−)(+)$H_2NR^3R^2$, —$SO_3$(−)(+)$H_3NR^2$, —$SO_2NR^3R^2$ or —$SO_3R^2$; and —X—$R^1$ is —Y—$R^2$ or —$CONR^3R^1$, —$CO_2$(−)(+)$NRR_3{}^3R^1$, —$CO_2$(−)(+)$HNR_2{}^3R^1$, —$R^4$—$COOR_1$, —$NR^3COR^1$, —$R^4OR^1$, —$R^4OCOR^1$, —$R^4$,$R^1$, —N($COR^3$)$R^1$ or Z(−)(+)$NR_3{}^3R^1$; —Z(−) is $SO_3$(−) or —$CO_2$(−);

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

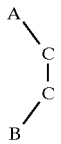

the carbon—carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that X—$R^1$ and Y—$R^2$ between them contain at least three alkyl, alkoxyalkyl or polyalkoxyalkyl groups.

Multicomponent additive systems may be used and the ratios of additives to be used will depend on the fuel to be treated.

(iii) EP-A-0,316,108 describes an amine or diamine salt of (a) a sulphosuccinic acid, b) an ester or diester of a sulphosuccinic acid, c) an amide or a diamide of a sulphosuccinic acid, or d) an ester-amide of a sulphosuccinic acid.

(iv) WO 9304148 describes a chemical compound comprising or including a cyclic ring system, the compound carrying at least two substituents of the general formula (I) below on the ring system $$—A—NR^1R^2 \quad (1)$$

where A is an aliphatic hydrocarbyl group that is optionally interrupted by one or more hetero atoms and that is straight chain or branched, and $R^1$ and $R^2$ are the same or different and each is independently a hydrocarbyl group containing 9 to 40 carbon atoms optionally interrupted by one or more hetero atoms, the substituents being the same or different and the compound optionally being in the form of a salt thereof.

Preferably, A has from 1 to 20 carbon atoms and is preferably a methylene or polymethylene group.

Each hydrocarbyl group constituting $R^1$ and $R^2$ in the invention (Formula 1) may for example be an alkyl or alkylene group or a mono- or poly-alkoxyalkyl group. Preferably, each hydrocarbyl group is a straight chain alkyl group. The number of carbon atoms in each hydrocarbyl group is preferably 16 to 40, more preferably 16 to 24.

Also, it is preferred that the cyclic system is substituted with only two substituents of the general formula (I) and that A is a methylene group.

Examples of salts of the chemical compounds are the acetate and the hydrochloride.

The compounds may conveniently be made by reducing the corresponding amide which may be made by reacting a secondary amine with the appropriate acid chloride. WO 9407842 describes other compounds (Mannich bases) in this classification.

(v) A condensate of long chain primary or secondary amine with a carboxylic acid-containing polymer.

Specific examples include polymers such as described in GB-A-2,121,807, FR-A-2,592,387 and DE-A-3,941,561; and also esters of telemer acid and alkanoloamines such as described in U.S. Pat. No. 4,639,256; and the reaction product of an amine containing a branched carboxylic acid ester, an epoxide and a mono-carboxylic acid polyester such as described in U.S. Pat. No. 4,631,071.

EP-0,283,292 describes amide containing polymers and EP-0,343,981 describes amine-salt containing polymers.

It should be noted that the polar nitrogen compounds may contain other functionality such as ester functionality.

(D) A hydrocarbon polymer.

Examples of suitable hydrocarbon polymers are those of the general formula

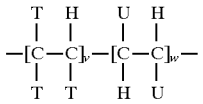

wherein T=H or $R^{21}$ wherein $R^{21}$=$C_1$ to $C_{40}$ hydrocarbyl, and

U=H, T, or aryl and v and w represent mole fractions, v being within the range of from 1.0 to 0.0, w being in the range of from 0.0 to 1.0.

The hydrocarbon polymers may be made directly from monoethylenically unsaturated monomers or indirectly by hydrogenating polymers from polyunsaturated monomers, e.g., isoprene and butadiene.

Examples of hydrocarbon polymers are disclosed in WO 91/11488.

Preferred copolymers are ethylene Δ-olefin copolymers, having a number average molecular weight of at least 30,000. Preferably the Δ-olefin has at most 28 carbon atoms. Examples of such olefins are propylene, 1-butene, isobutene, n-octene-1, isooctene-1, n-decene-1, and n-dodecene-1. The copolymer may also comprise small amounts, e.g, up to 10% by weight, of other copolymerizable monomers, for example olefins other than Δ-olefins, and non-conjugated dienes. The preferred copolymer is an ethylene-propylene copolymer.

The number average molecular weight of the ethylene Δ-olefin copolymer is, as indicated above, preferably at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 percent. More advantageously, the ethylene content is within the range of from 57 to 80%, and preferably it is in the range from 58 to 73%; more preferably from 62 to 71%, and most preferably 65 to 70%.

Preferred ethylene-Δ-olefin copolymers are ethylene-propylene copolymers with a molar ethylene content of from 62 to 71% and a number average molecular weight in the range 60,000 to 120,000; especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include a low molecular weight ethylene-Δ-olefin copolymer, advantageously with a number average molecular weight of at most 7500, advantageously from 1,000 to 6,000, and preferably from 2,000 to 5,000, as measured by vapour phase osmometry. Appropriate Δ-olefins are as given above, or styrene, with propylene again being preferred. Advantageously the ethylene content is from 60 to 77 molar percent, although for ethylene-propylene copolymers up to 86 molar percent by weight ethylene may be employed with advantage.

(E) Linear, eg polyoxyalkylene compounds.

Such compounds comprise a compound in which at least one substantially linear alkyl group having 10 to 30 carbon atoms is connected via an optional linking group that may be branched to a non-polymeric residue, such as an organic residue, to provide at least one linear chain of atoms that includes the carbon atoms of said alkyl groups and one or more non-terminal oxygen, sulphur and/or nitrogen atoms. The linking group may be polymeric.

By "substantially linear" is meant that the alkyl group is preferably straight chain, but that straight chain alkyl groups having a small degree of branching such as in the form of a single methyl group branch may be used.

Preferably, the compound has at least two of said alkyl groups when the linear chain may include the carbon atoms of more than one of said alkyl groups. When the compound has at least three of said alkyl groups, there may be more than one of such linear chains, which chains may overlap. The linear chain or chains may provide part of the linking group between any two such alkyl groups in the compound.

The oxygen atom or atoms, if present, are preferably directly interposed between carbon atoms in the chain and may, for example, be provided in the linking group, if present, in the form of a mono- or poly-oxyalkylene group, said oxyalkylene group preferably having 2 to 4 carbon atoms, examples being oxyethylene and oxypropylene.

As indicated the chain or chains include carbon, oxygen, sulphur and/or nitrogen atoms.

The compound may be an ester where the alkyl groups are connected to the remainder of the compound as —O—CO n alkyl, or —CO—O n alkyl groups, in the former the alkyl groups being derived from an acid and the remainder of the compound being derived from a polyhydric alcohol and in the latter the alkyl groups being derived from an alcohol and the remainder of the compound being derived from a polycarboxylic acid. Also, the compound may be an ether where the alkyl groups are connected to the remainder of the compound as —O—n—alkyl groups. The compound may be both an ester and an ether or it may contain different ester groups.

Examples include polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkylene group in said polyoxyalkylene glycol containing from 1 to 4 carbon atoms, as described in EP-A-61 895 and in U.S. Pat. No. 4,491,455.

The preferred esters, ethers or ester/ethers which may be used may comprise compounds in which one or more groups (such as 2, 3 or 4 groups) of formula —$OR^{25}$ are bonded to a residue E, where E may for example represent A(alkylene)q, where A represents C or N or is absent, q represents an integer from 1 to 4, and the alkylene group has from one to four carbon atoms, A (alkylene)q for example being $N(CH_2CH_2)_3$; $C(CH_2)_4$; or $(CH_2)_2$; and $R^{25}$ may independently be (a) n-alkyl- (b) n-alkyl—CO—

(c) n-alkyl—OCO—$(CH_2)$n-

(d) n-alkyl—OCO—$(CH_2)_n$CO— n being, for example, 1 to 34, the alkyl group being linear and containing from 10 to 30 carbon atoms. For example, they may be represented by the formula $R^{23}OBOR^{24}$, $R^{23}$ and $R^{24}$ each being defined as for $R^{25}$ above, and B representing the polyalkylene segment of the glycol in which the alkylene group has from 1 to 4 carbon atoms, for example, polyoxymethylene, polyoxyethylene or polyoxytrimethylene moiety which is substantially linear; some degree of branching with lower alkyl side chains (such as in polyoxypropylene glycol) may be tolerated but it is preferred that the glycol should be substantially linear.

Suitable glycols generally are substantially linear polyethylene glycols (PEG) and polypropylene glycols (PPG) having a molecular weight of about 100 to 5,000, preferably about 200 to 2,000. Esters are preferred and fatty acids containing from 10 to 30 carbon atoms are useful for reacting with the glycols to form the ester additives, it being preferred to use $C_{18}$ to $C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred when the petroleum based component is a narrow boiling distillate, when minor amounts of monoethers and monoesters (which are often formed in the manufacturing process) may also be present. It is important for active performance that a major amount of the dialkyl compound is present. In particular, stearic or behenic diesters of polyethylene glycol, polypropylene glycol or polyethylene/polypropylene glycol mixtures are preferred.

Examples of other compounds in this general category are those described in Japanese Patent Publication Nos. 2-51477 and 3-34790, and EP-A-117,108 and EP-A-326,356, and cyclic esterified ethoxylates such as described EP-A-356,256.

It is within the scope of the invention to use two or more flow improvers advantageously selected from one or more of the different classes outlined above.

The flow improver is advantageously employed in a proportion within the range of from 0.001 to 1%, e.g. from 0.01% to 1% advantageously 0.05% to 0.5%, and preferably from 0.075 to 0.25%, by weight, based on the weight of fuel.

The flow improver may also be used in combination with one or more other co-additives such as known in the art, for example the following: detergents, antioxidants, corrosion inhibitors, dehazers, demulsifiers, antifoaming agents, cetane improvers, cosolvents, package compatibilizers, and other, known, lubricity additives.

EXAMPLES

The following Examples illustrate the invention:

In the examples, the HFRR test was employed under the following conditions, wear being measured at 60° C. throughout.

| | |
|---|---|
| LOAD | 2 N |
| STROKE | 1 mm (0.5 mm AMPLITUDE) |
| FREQUENCY | 50 Hz |
| TEMPERATURE | 60° C. |
| METALLURGY | BALL ANSI 52 100 (hardened bearing tool steel) 645 HV 30<br>FLAT ANSI 52 100 (bearing tool steel) 180 HV 30 |
| DURATION | 75 minutes |

Wear was measured at the end of the test.
Various additives were tested in Fuels I, II and III.

Fuel I is a Class 1 diesel fuel commercially available in Sweden. The characteristics of the fuel were as follows:

| | |
|---|---|
| Specific Gravity: | 0.8088 |
| Sulphur: | 0.001 wt % |
| Distillation, °C., IBP | 186 |
| 10% | 203 |
| 50% | 225 |
| 95% | 273 |

The HFRR results on the fuel alone were as follows:

| WEAR, μm. |
|---|
| 701 |
| (results are mean of two tests) |

Fuel II has the following characteristics

| | | |
|---|---|---|
| Specific Gravity | | 0.8184 |
| Sulphur | | 0.03 wt % |
| Distillation, °C., | IBP | 156 |
| | 10% | 192 |
| | 20% | 202 |
| | 50% | 233 |
| | 90% | 303 |
| | 95% | 326 |
| | FBP | 355 |

The HFRR results on the fuel alone were as follows:

| WEAR, μm |
|---|
| 575 |
| (result is the mean of two tests). |

Fuel III has the following characteristics:

| | | |
|---|---|---|
| Specific Gravity | | 0.8204 |
| Sulphur | | 0.03 wt % |
| Distillation, °C., | IBP | 161 |
| | 10% | 197 |
| | 20% | 208 |
| | 50% | 239 |
| | 90% | 301 |
| | 95% | 314 |
| | FBP | 336 |

The HFRR result on the fuel alone was 585 μm (mean of two tests)

Various additives were used in the numbered Examples, the results and the treat rates, in ppm by weight of active ingredient based on the weight of the fuel, being given in the Tables.

Additives used

Example 1

A polar nitrogen compound, an N,N-dialkylammonium salt of 2-N'N' dialkylamidobenzoate, the product of reacting one mole of phthalic anhydride and two moles of di(hydrogenated tallow) amine.

Example 2

A cold flow improver additive commercially available from BASF as "Keroflux 3243" and believed to contain the reaction product of ethylene diamine tetracetic acid and di(hydrogenated tallow) amine in a mole ratio of 1:4, in combination with an ethylene-vinyl propionate copolymer.

Example 3

A cold flow improver additive commercially available from Hoechst as "Dodiflow V/4237" and believed to contain the reaction product of an alkenyl spiro bislactone with one mole of di(hydrogenated tallow) amine and one mole of (hydrogenated tallow) amine.

Example 4

An ethylene-vinyl acetate copolymer, vinyl acetate content 13.5%, Mn 5000, measured by gel permeation chromatography (GPC).

Example 5

An ethylene-vinyl acetate copolymer, vinyl acetate content 36.5 wt%, Mn 3000 (GPC).

Example 6

Ethylene-vinyl acetate copolymer; 29 wt% vinyl acetate, Mn 3400 (GPC).

Example 7

Ethylene-vinyl acetate copolymer; 28 wt% vinyl acetate, Mn 18000 (GPC).

Example 8

1:3 (wt/wt) blend of Examples 4 and 5.

Example 9

An ethylene-vinyl propionate copolymer, 38 wt% vinyl propionate Mn approximately 5200 (CPC).

Example 10

A dodecyl fumarate-vinyl acetate (mole ratio 1:1) comb polymer.

Example 11

A hexadecyl itaconate comb polymer.

Example 12

An octadecyl itaconate comb polymer.

Example 13

A tetradecyl fumarate~styrene mole ratio 1:1 comb polymer.

Example 14

The reaction product of ethylene diamine tetracetic acid and di(hydrogenated tallow) amine in a mole ratio of 1:4.

Example 15

The reaction product of nitriloacetic acid and di(hydrogenated tallow) amine in a mole ratio of 1:3.

Example 16

The reaction product of one mole of an alkenyl spiro bislactone with one mole of di(hydrogenated tallow) amine and one mole of (hydrogenated tallow) amine.

RESULTS (FUEL I)

| Example | Treat Rate, ppm | Wear, μm |
|---|---|---|
| 1 | 1334 | 254 |
| 2 | 1000 | 246 |
| 3 | 920 | 313 |
| 4 | 452 | 328 |
| 5 | 1456 | 301 |
| 6 | 1200 | 486 |
| 7 | 500 | 274 |
| 8 | 904 | 290 |
| 9 | 1000 | 471 |
| 10 | 800 | 226 |
| 11 | 1760 | 192 |
| 12 | 1760 | 240 |
| 13 | 980 | 311 |
| Fuel Alone | — | 701 |

The results show that all the flow improvers enhance lubricity, as measured by wear reduction, the dodecyl fumarate-vinyl acetate comb copolymer being outstanding even at a low treat rate.

FUEL II

| Example and (Treat Rate (ppm)) | | | Wear μm |
|---|---|---|---|
| (i) | 1(60) | | 480 |
| | | 4(450) | 535 |
| | 1(60); | 4(495) | 340 |
| (ii) | 1(60) | | 480 |
| | | 9(750) | 565 |
| | 1(60); | 9(700) | 305 |
| (iii) | 1(60) | | 480 |
| | | 2(165) | 420 |
| | 1(60); | 2(165) | 300 |
| (iv) | 1(60) | | 480 |
| | | 2(150) | 495 |
| | 1(60); | 2(150) | 315 |
| Fuel Alone | | — | 575 |

The results show that all the flow improvers enhance lubricity and that certain combinations of flow improvers act synergistically in enhancing lubricity, as measured by wear reductions.

FUEL III

| Example and (Treat Rate (ppm)) | Wear (μm) |
|---|---|
| 14(300) | 340 |
| 15(300) | 380 |
| 16(300) | 405 |
| 1(300) | 385 |
| 1(144); 4(36) | 385 |
| Fuel Alone | 585 |

The results show that the polar nitrogen compounds tested enhanced lubricity and that a small quantity of the ethylene-vinyl acetate copolymer of Example 4 enhanced the lubricity of the polar nitrogen compound of Example 1.

I claim:

1. A process for the manufacture of a low sulfur content, middle distillate petroleum based fuel oil composition of enhanced lubricity without the need for addition of a conventional lubricity enhancing additive, which process comprises refining a crude oil to produce a refined middle distillate fuel oil product having a sulfur content of at most 0.2% by weight, and blending at least one cold flow improver with the refined middle distillate fuel oil product to provide a middle distillate fuel oil composition having a lubricity such as to give a wear scar diameter, as measured by the HFFR test at 60° C., of at most 500 μm.

2. The process of claim 1 wherein the cold flow improver is an oil-soluble polar nitrogen compound carrying one or more substituents of the formula $>NR^{13}$, where $R^{13}$ represents a hydrocarbyl group containing 8 to 40 carbon atoms, which substituent or one or more of which substituents may be in the form of a cation derived therefrom.

3. The process of claim 1 wherein the cold flow improver is an ethylene-unsaturated ester copolymer.

4. The process of claim 1 wherein the cold flow improver is a comb polymer comprising a homopolymer having, or a copolymer at least 25 molar percent of the units of which have, side chains containing at least 6 carbon atoms.

5. The process of any of the preceding claims 1–4 wherein two or more cold flow improvers are present.

6. The process of any of the preceding claims 1–4 wherein from 0.001 to 1% by weight of the cold flow improver or improvers based on the weight of the fuel are present.

7. The process of any of the preceding claims 1–4 wherein the sulphur content of the composition is at most 0.05% by weight.

8. The process of claim 1 wherein the flow improver is a dodecyl fumarate-vinyl acetate comb copolymer.

9. The process of claim 5 wherein the cold flow improvers are an ethylene vinyl acetate copolymer and a polar nitrogen compound.

10. A process for the manufacture of a low sulfur content, middle distillate petroleum based fuel oil composition of enhanced lubricity without the need for addition of a conventional lubricity enhancing additive, which process comprises refining a crude oil to produce a refined middle distillate fuel oil product having a sulfur content of at most 0.2% by weight, and blending at least one cold flow improver with the refined middle distillate fuel oil product to provide a middle distillate fuel oil composition having a lubricity such as to give a wear scar diameter, as measured by the HFFR test at 60° C., of at most 500 μm, wherein the cold flow improver is selected from the group consisting of an oil-soluble polar nitrogen compound carrying one or more substituents of the formula $>NR^{13}$, where $R^{13}$ represents a hydrocarbyl group containing 8 to 40 carbon atoms, which substituent or one or more of which substituents may be in the form of a cation derived therefrom, an ethylene-unsaturated ester copolymer, and a comb polymer comprising a homopolymer having, or a copolymer at least 25 molar percent of the units of which have, side chains containing at least 6 carbon atoms.

* * * * *